US007246829B1

(12) United States Patent
Balsbaugh et al.

(10) Patent No.: US 7,246,829 B1
(45) Date of Patent: Jul. 24, 2007

(54) SLIDING DOOR LATCH FOR HANDICAPPED PEOPLE

(76) Inventors: Vernon L. Balsbaugh, 2074 Laura La., Dallas, OR (US) 97338; Philip D. Grover, 4999 Morrow Rd., Modesto, CA (US) 95356

( * ) Notice: Subject to any disclaimer, the term of this patent is extended or adjusted under 35 U.S.C. 154(b) by 0 days.

(21) Appl. No.: 10/867,582

(22) Filed: Jun. 14, 2004

Related U.S. Application Data

(60) Provisional application No. 60/539,262, filed on Jan. 27, 2004.

(51) Int. Cl.
*E05C 19/00* (2006.01)

(52) U.S. Cl. ..... 292/304; 292/DIG. 46; 292/102

(58) Field of Classification Search ..... 292/DIG. 46, 292/128, 136, 101, 102, 300, 304
See application file for complete search history.

(56) References Cited

U.S. PATENT DOCUMENTS

| | | | | | |
|---|---|---|---|---|---|
| 1,459,812 | A | * | 6/1923 | Zeman | 292/124 |
| 2,749,164 | A | * | 6/1956 | Kitzelman | 292/121 |
| 3,907,344 | A | * | 9/1975 | Newlon et al. | 292/66 |
| 4,248,461 | A | * | 2/1981 | Stevens | 292/218 |
| 4,461,500 | A | * | 7/1984 | van der Horst | 292/128 |
| 4,500,122 | A | * | 2/1985 | Douglas | 292/161 |
| 5,653,483 | A | * | 8/1997 | Grover | 292/194 |

* cited by examiner

*Primary Examiner*—Gary Estremsky
(74) *Attorney, Agent, or Firm*—Robert M. Sperry, Esq.

(57) ABSTRACT an improved sliding door latch comprising a latch plate attached to the leading edge of the door and projecting outwardly on either side of the door to enable a person to grasp the latch plate to slide the door open or closed, and a latch arm pivotally secured to the door jamb and movable between a first unlocked position which permits the door to be opened or closed and a latched position engaging the latch plate and preventing movement of the door.

5 Claims, 3 Drawing Sheets

SLIDING DOOR LATCH FOR HANDICAPPED PEOPLE

RELATED CASES

This invention is described in my copending Provisional Application Ser. No. 60/539,262, filed Jan. 27, 2004.

FIELD OF INVENTION

This invention relates to door latches and is particularly directed to improved sliding door latches for use by handicapped people.

PRIOR ART

Sliding doors are often found in residences, motor homes, boats and the like, especially on closets, bathrooms and the like, and many of these doors are provided with latches for privacy, security or other reasons. However, many of the prior art sliding door latches have required that large holes or cutouts be made in the door or jamb to permit installation of the latch. Thus, these prior art sliding door latches have been difficult to install, especially as retrofits to existing doors. Consequently, none of the prior art sliding door latches have been entirely satisfactory.

BRIEF SUMMARY AND OBJECTS OF INVENTION

These disadvantages of the prior art are overcome with the present invention and an improved sliding door latch is provided which can be installed quickly and easily on virtually any sliding door without requiring drilling holes or making cutouts and which can easily be operated by persons of limited mobility or those confined to wheel chairs and the like.

These advantages of the present invention are preferably attained by providing an improved sliding door latch comprising a latch plate attached to the leading edge of the door and projecting outwardly on either side of the door to enable a person to grasp the latch plate to slide the door open or closed, and a latch arm pivotally secured to the door jamb and movable between a first unlocked position which permits the door to be opened or closed and a latched position engaging the latch plate and preventing movement of the door.

Accordingly, it is an object of the present invention to provide an improved door latch.

Another object of the present invention is to provide an improved latch for sliding doors.

An additional object of the present invention is to provide an improved sliding door latch which can be installed quickly and easily.

A further object of the present invention is to provide an improved sliding door latch which can be installed quickly and easily without requiring drilling holes or making cutouts.

Another object of the present invention is to provide an improved sliding door latch which can be installed quickly and easily without requiring drilling holes or making cutouts and which can be operated by persons of limited mobility or those confined to wheel chairs and the like.

A specific object of the present invention is to provide an improved sliding door latch comprising a latch plate attached to the leading edge of the door and projecting outwardly on either side of the door to enable a person to grasp the latch plate to slide the door open or closed, and a latch arm pivotally secured to the door jamb and movable between a first unlocked position which permits the door to be opened or closed and a latched position engaging the latch plate and preventing movement of the door.

These and other objects and features of the present invention will be apparent from the following detailed description, taken with reference to the figures of the accompanying drawing.

DETAILED DESCRIPTION OF THE INVENTION

Figure 1:
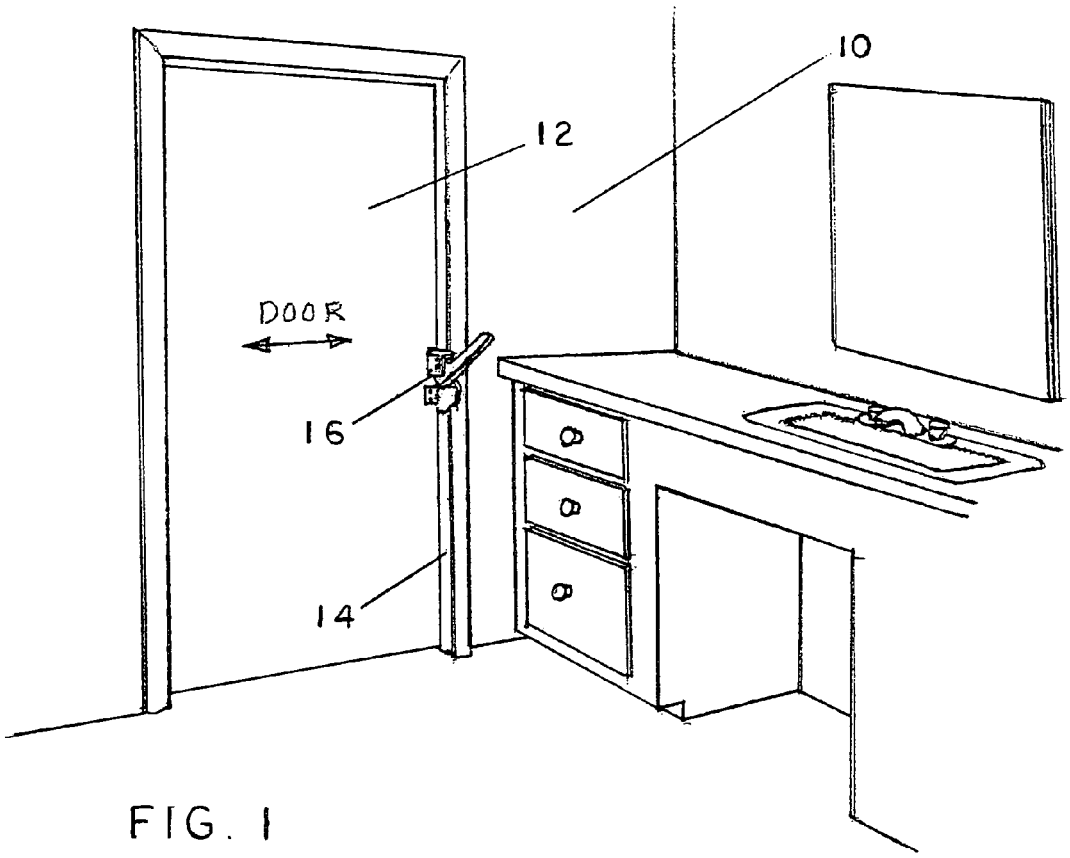
FIG. 1 is an isometric view showing a sliding door embodying the latch of the present invention.
Figure 2:
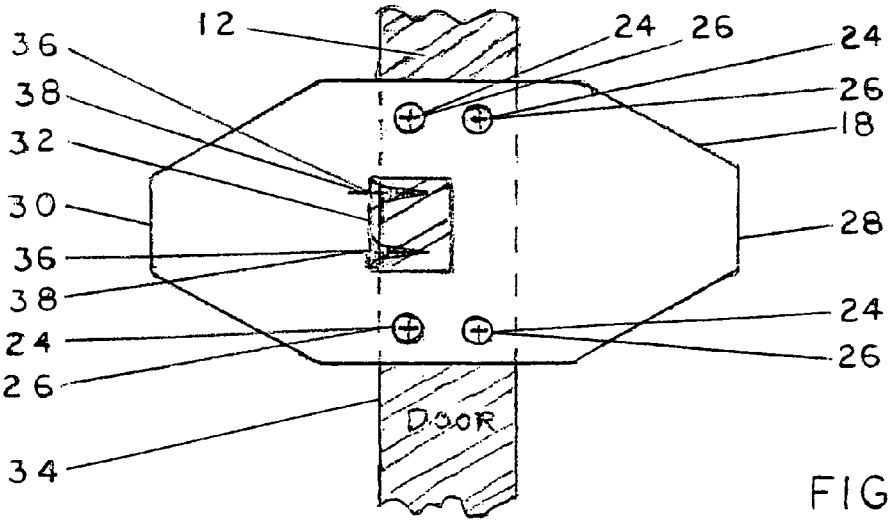
FIG. 2 is a view showing the leading edge of the sliding door with the latch plate of the sliding door latch of FIG. 1 mounted thereon.
Figure 3:
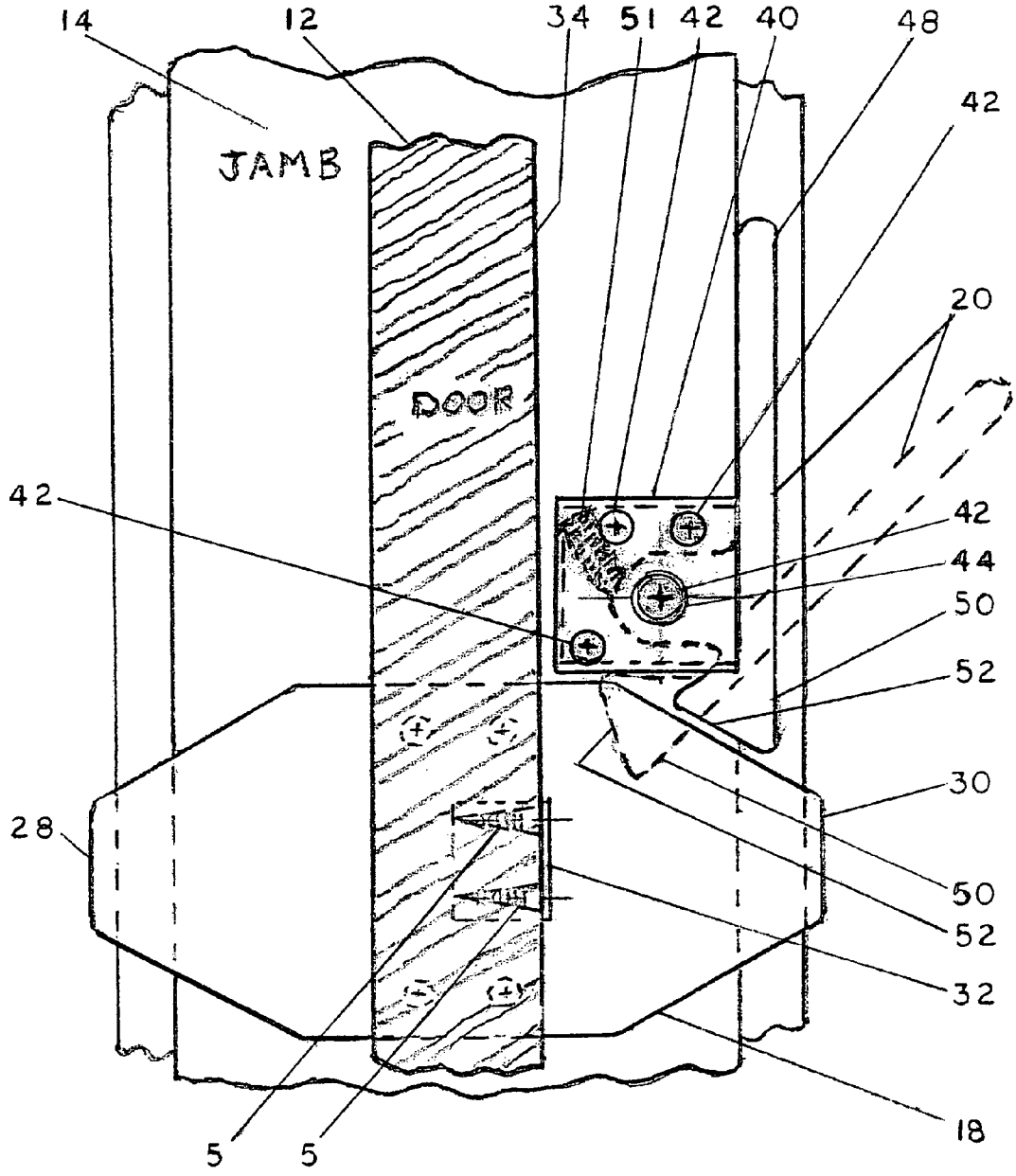
FIG. 3 is a view, partly in section, showing the jamb of the sliding door with the latch arm of the sliding door latch of FIG. 1 mounted thereon.
Figure 4:
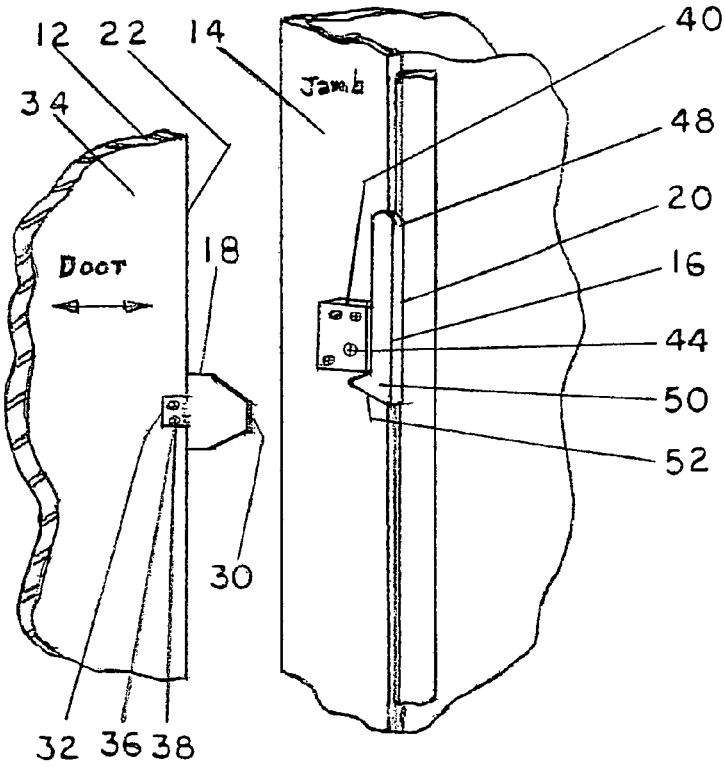
FIG. 4 is a diagrammatic representation showing the sliding door of FIG. 1 spaced from the jamb.
Figure 5:
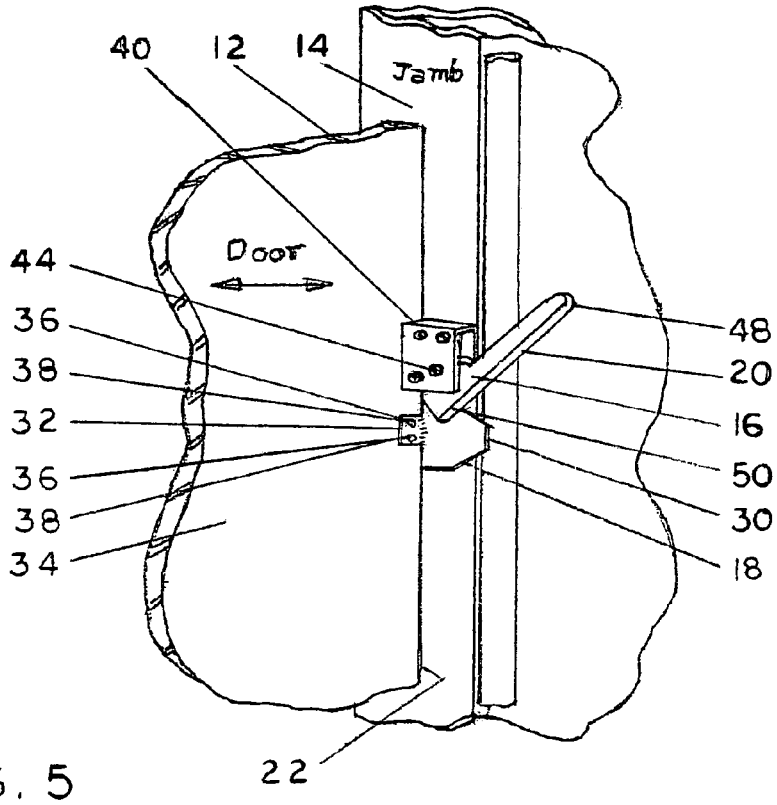
FIG. 5 is a view similar to that of FIG. 4 showing the sliding door in the locked position.

In that form of the present invention chosen for purposes of illustration, FIG. 1 shows a room, indicated generally at 10, having a sliding door 12 movable toward and away from a door jamb 14 and having a sliding door latch, indicated generally at 16, for selectably locking and unlocking the sliding door 12 to the jamb 14 to provide privacy or security for persons within the room 10. The sliding door latch 16 comprises a latch plate 18, carried by the door 12 and a latch arm 20, pivotally mounted on the door jamb 14 and movable to engage or release the latch plate 18. As best seen in FIG. 2, the latch plate 18 is mounted on the leading edge 22 of the sliding door 12 by four screws 24 inserted through openings 26 in the latch plate 18 and into the leading edge 22 of the sliding door 12 and carries two access panels 28 and 30 which project outwardly on opposite sides of the door 12 to allow a person to grasp the adjacent one of the access panels 28 or 30 to facilitate opening or closing the sliding door 12. Preferably the latch plate 18 is provided with a flange 32 which lies along the inner side 34 of the sliding door 12 and is secured by two screws 36 inserted through holes 38 in the flange 32. As seen in FIG. 3, the latch arm 20 comprises a mounting box 40 which is secured to the doorjamb 14 by four screws 42 and carries the latch arm 20 pivotally secured within the mounting box 40. The latch arm 20 is pivotally mounted on a cylindrical roll pin 44 which extends through the mounting box 40. One of the mounting screws 42 passes through the roll pin 44 and, hence, allows the mounting box 40 to be mounted reversibly with the latch arm 20 on either the right or left side of the mounting box 40. The latch arm 20 has a handle portion 48 which normally lies in a vertical position and has a latching portion 50 having an inclined lower edge 52 which is shaped to allow passage of access panel 30 of the latching plate 18 for opening and closing the door 12. However, when latch handle 48 is lowered, the latching portion 50 will be moved to engage the access panel 30 to lock the door 12 closed. To release the latch 16, the person simply raises the latch handle 48, which cause the latching portion 50 to pivot out of contact with the access panel 30 and, hence, to allow opening of the door 12. To further facilitate movement of the latch arm 20, a spring 51 may, if desired, be connected between the mounting box 40 and flange 46 of the latch arm 20.

In use, to enter the room 10, the person opens the sliding door 12 by grasping access panel 28 and sliding the door 12 open. The person is then free to enter the room 10. Once in the room 10, the person grasps access panel 30 and slides the door 12 closed. If they desire to lock the door 12, they simply grasp the latch handle 48 and pull it downward, causing the latching portion 50 to engage the access panel 30 and, thus, locking the door. To open the door 12, the person simply raises latch handle 48, causing the latch portion 50 to release the access panel 30. Thereafter, the person can grasp the access panel 30 and use it to slide the door 12 open.

Obviously, numerous variations and modifications can be made without departing from the spirit of the present invention. Therefore, it should be clearly understood that the form of the present invention described above and shown in the figures of the accompanying drawing are illustrative only and are not intended to limit the scope of the present invention.

What is claimed is:

1. A sliding door latch comprising:

a latch plate mounted on the leading edge of said door and having a pair of access panels projecting outwardly on respective sides of said door, and a latch box mounted on the door jamb and having a handle portion pivotally carried thereby, said handle portion having a latch portion movable into and out of engagement with said latch plate to releasably secure said door, said handle normally lies in the raised open position.

2. The sliding door latch of claim 1 wherein:

said latch portion having an edge shaped to allow movement of said access panel when said handle is in the open position and engaging said access panel when said handle is in the locked position.

3. The sliding door latch of claim 1 wherein:

said handle is resiliently urged to said raised position.

4. The sliding door latch of claim 1 wherein:

said latch is reversible.

5. The sliding door latch of claim 1 wherein:

said latch box may be reversably mounted on either side of said door jamb.

* * * * *